United States Patent [19]

Hass et al.

[11] Patent Number: 4,600,023

[45] Date of Patent: Jul. 15, 1986

[54] PROCESS FOR THE PREPARATION OF AROMATIC SUBSTANCES FROM DITERPENE FRACTIONS

[75] Inventors: Werner Hass, Hamburg; Volker Heemann, Reinbek, both of Fed. Rep. of Germany

[73] Assignee: B.A.T. Cigaretten Fabriken GmbH, Hamburg, Fed. Rep. of Germany

[21] Appl. No.: 611,755

[22] Filed: May 18, 1984

[30] Foreign Application Priority Data

May 20, 1983 [DE] Fed. Rep. of Germany ..... 3318546

[51] Int. Cl.[4] ..... A24B 15/30

[52] U.S. Cl. ..... 131/275; 131/297; 131/298

[58] Field of Search ..... 131/275, 297, 298

[56] References Cited

U.S. PATENT DOCUMENTS

| | | | |
|---|---|---|---|
| 3,889,689 | 6/1975 | Rosen | 131/297 |
| 4,267,847 | 5/1981 | Reid | 131/275 |
| 4,351,346 | 9/1982 | Brummer et al. | 131/276 |
| 4,359,059 | 11/1982 | Brummer et al. | 131/276 |

FOREIGN PATENT DOCUMENTS

| | | |
|---|---|---|
| 0638327 | 6/1950 | United Kingdom . |
| 1489762 | 10/1977 | United Kingdom . |

OTHER PUBLICATIONS

*The Merck Index,* The Merck & Co. Inc., Rahway, New Jersey, 1983, p. 265.

Hackh's Chemical Dictionary, Fourth Edition, Grant, McGraw-Hill Book Company, 1969, p. 138.

Tobacco Chemistry, 48, Synthesis of Tobacco Labdanoids by Sensitized Photo-Oxygenation of (16E)-Abienol, Acta Chemica Scandinavica, B33 (1979).

Tobacco Chemistry, 43, Sensitized Photo-Oxygenation of (12Z)-Abienol, Biomimetic Synthesis of Tobacco Labdanoids, Acta Chemica Scandinavica B32 (1978).

Chuman, et al., 41 Agric. Biol. Chem. 1021 (1977).

*Primary Examiner*—William R. Dixon, Jr.

*Assistant Examiner*—Margaret B. Medley

*Attorney, Agent, or Firm*—Arnold, White & Durkee

[57] ABSTRACT

Aromatic substances are produced from diterpene fractions in a solvent which is oxidized in the absence of photochemically active radiation. The oxidation is performed with an oxidizing agent in the presence of a catalyst. The oxidizing agent is selected from oxygen, peroxo compounds, halogenates and periodates. The catalyst is selected from compounds of tin, lead, cerium, and transition metals of groups Ib, IVb, Vb, VIb, VIIb and VIII.

14 Claims, No Drawings

PROCESS FOR THE PREPARATION OF AROMATIC SUBSTANCES FROM DITERPENE FRACTIONS

BACKGROUND OF THE INVENTION

This invention relates to processes for the preparation of aromatic substances from diterpene fractions. More particularly, the invention provides a novel process for preparing aromatic substances from diterpene fractions in an environment free of photochemically active radiation.

The surface resin of fresh tobacco plants contain diterpenes which, being smoke aroma precursors, influence the aroma of tabacco. Diterpene fractions are obtainable from many sources. For example, they can be obtained by extraction from the surface resin of fresh tobacco plants or parts of these, by extraction from raw tobacco or tobacco waste, e.g., tobacco dust, or by extraction from the plant gum derived from the tobacco blossoms. They can also be prepared synthetically.

A number of processes for isolating diterpenes from the surface resin of tobacco plants are known. In these processes undesired lipids present in the resin are removed. An example of this process is disclosed in German Offenlengungsschrift No. 2,918,920.

Photochemical reactions involving diterpenes are well known. The smoke aroma precursor properties of diterpenes isolated from tobacco plants has prompted work regarding the chemical structure of diterpenes and their reactions. In particular, diterpene photoreactions with singlet oxygen has been studied. For example, Acta Chemica Scandinavia 1979, pages 437–442 discloses such work. In these investigations, photo-oxidation of diterpenes was carried out in the presence of photochemical catalysts (sensitisers), for example Bengal Rose.

Various processes for preparing aromatic substances through photochemical reactions are known. German Patent Specification No. 3,009,032 and its counterpart U.S. Pat. No. 4,359,059 disclose a process for the preparation of aromatic substances by UV radiation of a tobacco extract containing diterpenes. The extract is irradiated in the presence of oxygen in the absence of photochemical catalysts (sensitisers). The oxidation is thus carried out by a conventional free-radical mechanism.

In another process, aromatic substances are prepared from a carotenoid fraction obtained from tobacco plants in which any diterpenes have been removed. The carotenoid fraction is oxidized with oxygen, in alcoholic solution, and with UV radiation. This process is disclosed, for example, by German Patent Specification No. 3,009,031 and its counterpart U.S. Pat. No. 4,351,346. The process can be carried out in the presence of photochemical catalysts (sensitisers) or in the absence of these. The reaction takes place either by means of a free-radical mechanism or via singlet oxygen as the oxidizing agent.

The present inventors have discovered a process for preparing tobacco aromatic substances that does not employ a photo-oxidation reaction. The resulting aromas have aromatic properties superior to those of the substances obtained by photochemical processes. Aromatic as used herein refers to odor and is not to be interpreted as reference to benzene or benzene type compounds.

SUMMARY OF THE INVENTION

The present invention provides a novel process for the preparation of aromatic substances from diterpene fractions. Diterpene fractions which can be obtained synthetically, by extraction from the surface resin of fresh tobacco plants or parts of these, from raw tobacco or tobacco waste, or from the plant gum derived from the tobacco blossoms, are oxidized in the absence of photochemically active radiation. In a photochemically free process, the aromatic substances are prepared from diterpene fractions by oxidation in the liquid phase wtih oxidizing agents in the presence of catalysts. The oxidizing agents which can be used include oxygen, peroxo compounds, halogenates or periodates. The catalysts which can be used include compounds of tin, lead, cerium and transition metals of groups Ib, IVb, Vb, VIb, VIIb, and VIII of the periodic table. In addition mixtures of these compounds can be used.

DETAILED DESCRIPTION OF THE INVENTION AND PREFERRED EMBODIMENTS

Oxidizing Agents

Oxidizing agents which may be used in the photochemically free process for preparing aromatic substances from diterpene fractions include oxygen, peroxo compounds, halogenates or periodates.

Typical examples of peroxo compounds which may be used include hydrogen peroxide or its salts, such as sodium peroxide or barium peroxide, t-butyl hydroperoxide and the like.

Peracids and their salts are also suitable in principle. However, if the free peracids and their acidic salts are used, it should be noted that these, on undergoing reduction, form strong protic acids which in turn affect the resulting aromatic substances in a disadvantageous manner. If peracids and their acidic salts are used, they should only be used in the presence of acid acceptors, for example, buffers or heterogeneously distributed solid bases, such as sodium bicarbonate.

Halogenates which may be used include chlorates, bromates, iodates and the like. However, it is advisable to check whether these oxidizing agents also give rise to undesired halogenation reactions in addition to oxidation.

Periodates which may be used include sodium metaperiodate which is a commercially available compound.

Catalysts

Catalysts which are suitable for the process of the invention include transition metal compounds, in particular, vanadium, niobium, tantalum, chromium, molybdnum, tungsten, manganese, rhenium, iron, cobalt, nickel, ruthenium, rhodium, palladium, osmium, iridium, platinum, copper, silver, gold, cerium, zirconium and the like.

In a preferred embodiment of the invention, the process of the invention is carried out in the homogeneous phase. Thus suitable catalysts are compounds of the above-mentioned transition metals which are soluble in the particular solvent systems. Examples of typical compounds which may be used in the process include acetylacetonates of zirconium, cobalt(III) and iron(III), vanadium oxidoacetylacetonate, copper(II) acetate, copper(II) chloride, silver fluoborate, chromium(III) chloride, potassium chromate, potassium dichromate, ammonium heptamolybdate, tungstosilicic acid, manganese sulfate, potassium permanganate, iron(III) chloride, cobalt(II) acetate, nickel(II) chloride, ruthenium dioxide, osmium tetroxide, palladium dichloride, palladium dichloride used in the form of its adducts with two moles of acetonitrile (particularly when t-butyl hydroperoxide is used as the oxidizing agent), platinum(IV) chloride, tin(II) chloride, lead acetate and the like. In addition, mixtures of the above stated transition metal catalysts may be used.

Catalysts are preferably used in an amount ranging from 0.01–5% by weight, relative to the amount of the diterpene fraction used. The addition of ten milligrams of catalysts per one gram of diterpene fraction is generally preferred.

Catalyst/Oxidizing Agent Systems

Not only should the catalysts be soluble in the particular solvent system used, but should be compatible with a particular oxidizing agent. For example, it would not be advisible to use hydrogen peroxide in the presence of vanadium compounds. Suitable catalyst/oxidizing agent systems can be obtained, for example, from the following literature:

Martin Schroder, Chem Rev. 1980, 80, 187–213;

Cand. J. Chem. 33, 1,701–1,713 (1955);

R. D. Clarke, Org. Prep. Proceed. Int. 6, 49, (1974);

K. B. Wiberg, Oxidation in Organic Chemistry, Part A, pages 9, 65, 237, Academic Press, New York (1965);

Houben-Weyl, Methoden der Organischen Chemie, Vol. IV/1*a* pages 148–154 and 251–264;

F. P. Greenspan, H. M. Woodburn, J. Am. Chem, Soc. 76, 6,345 (1954);

A. R. Doumaux jr., Oxidation Techiques and Applications in Organic Syntheses, R. L. Augustin, D. J. Trecker (Ed.), Vol. II, page 141 et seg., Dekker N.Y. (1971);

P. N. Ryland, Organic Syntheses with Noble Metal Catalysis, pages 77–87, 99–111, 121–141, Academic Press, N.Y. (1973).

The preferred catalysts/oxidizing agent systems used in the process include osmium tetroxide/sodium metaperiodate, osmium tetroxide/hydrogen peroxide/-sodium metaperiodate, potassium permanganate/-sodium metaperiodate, cerium(IV) sulfate/hydrogen peroxide, osmium tetroxide/hydrogen peroxide, silver fluoborate/hydrogen peroxide and silver nitrate/-sodium peroxodisulfate.

The oxidation can be carried out in water, water soluble inert organic solvents, and mixtures thereof. Examples of such solvents are methanol, ethanol, propanol, butanol, acetone, methylethylketone, tetrahydrofuran and dioxane.

Generally the oxidation is carried out at a temperature between about −20° and about 60° C. The oxidation time ranges from about 60 minutes to about three weeks. The reaction parameters depend in part on the source of the diterpene fraction. In addition, higher reaction temperatures will lead to shorter reaction time. A simple olfactory test of the resulting oxidation products may be used to determine suitable parameters.

The resulting aromatic substances can be isolated from the reaction mixture by steam distillation or in some cases by separating the resulting substances into a neutral fraction and an acidic fraction by extraction with a suitable extraction media. An olfactory test of the resulting aromatic substances can be used to determine which separation leads to an improvement in the properties of one or the other fraction.

In addition, the diterpene fraction can be treated before oxidation with dilute or buffered protic acids such as small amounts of hydrochloric acid or sulfuric acid in dioxane.

In another embodiment of the invention, particularly advantageous results are obtained if the diterpene fraction is preoxidized with a mild oxidizing agent. "Mild" means that the oxidizing action is not as strong as that of the catalyst/oxidizing agent systems to be employed. One example of a particularly suitable "mild" oxidizing agent is manganese dioxide.

EXAMPLES

The following examples are presented to describe the present invention in more detail. Such examples are presented for purposes of illustration only and shall not under any circumstances be deemed as limiting the present invention.

Preparation of a Diterpene Fraction

Green tobacco leaves are washed twice for 30 seconds each time with methylene chloride in an amount of 1 liter/kg of tobacco leaves. The diterpenes are then separated off from the accompanying substances in the methylene chloride fraction in a conventional manner by chromatography over silica gel or by phase partition. After the solvent has been evaporated, the diterpene fraction thus obtained is taken up in one of the above solvents suitable for the oxidation. The solution can be processed further in accordance with one of the examples below.

EXAMPLE 1

5 mg of $OsO_4$ are added to 10 g of extract in 100 ml of 1,4-dioxane and 15 ml of water, and the mixture is stirred for 15 minutes at room termperature. 15 g of finely powdered $NaIO_4$ are added in 10 portions in the course of 8 hours, and stirring is continued for a further 24 hours. Solid $Na_2S_2O_5$ is added at 0° C., while cooling on an icebath, until a sample gives a negative potassium iodide/starch reaction. 150 ml of saturated sodium chloride solution is added, after which the mixture is extracted three times with 100 ml of ether. The organic phase is washed twice with semisaturated sodium chloride solution and dried over $MgSO_4$, and the solvent is evaporated off in vacuo. The residue is filtered with 100 ml of ether through 10 g of silica gel, and the filtrate is evaporated down.

Oxidation with 25 g of $NaIO_4$ leads to similar results.

EXAMPLE 2

0.5 ml of a saturated aqueous $NaIO_4$ solution is added to 10 g of an extract and 5 mg of $OsO_4$ in 150 ml of tetrahydrofuran, and the mixture is then stirred for 1 hour. After 5 ml of $H_2O_2$ (30%) have been added, the reaction mixture is left at room temperature. 5 ml of $H_2O_2$ (30%) are added daily over 4 days. After a further week, solid $Na_2S_2O_5$ is added, while cooling with ice, until a sample gives a negative reaction with potassium iodide/starch paper. After 200 ml of saturated sodium chloride solution have been added, the mixture is extracted with ether, and the ether phase is washed with semisaturated sodium chloride solution, dried over $MgSO_4$ and then evaporated down. The residue is filtered with ether/methanol through 10 g of silica gel, and the filtrate is evaporated down.

EXAMPLE 3

1 g of extract in 30 ml of 70% strength t-butanol is stirred vigorously with 5 g of $NaIO_4$, 5 g of $K_2CO_3$ and 10 mg of $KMnO_4$ for 4 hours at 0° C. 50 ml of water and 50 ml of ether are added. The ether phase is washed with saturated $NaHCO_3$ solution and dried over $MgSO_4$, and the solvent is stripped off.

The combined aqueous extracts are brought to pH 1 with 6N HCL, and are extracted with ether. The organic phase is washed with semisaturated sodium chloride solution and dried over $MgSO_4$, and the ether is removed.

EXAMPLE 4

1 ml of $H_2O_2$ (30%) is added to a solution of 100 mg of cerium(IV) sulfate in 50 ml of methanol. After 5 minutes, 5 g of extract in 20 ml of methanol are added, and 5 ml of $H_2O_2$ (30%) are added dropwise at 40° C. in the course of 1 hour. After the mixture has been stirred for a further hour at 40° C., it is cooled to −15° to −20° C. and $Na_2S_2O_5$ is added until a sample gives a negative reaction with potassium iodide/starch paper. The reaction mixture is substantially freed from methanol in vacuo at a bath temperature of 20° C., and is partitioned between sodium chloride solution and ether. The ether phase is washed with semisaturated sodium chloride solution and dried over $MgSO_4$, and the solvent is evaporated off. The residue is subjected to steam distillation.

EXAMPLE 5

5 g of extract are stirred with 80 g of activated $MnO_2$ (Merck) in 250 ml of acetone or 250 ml of cyclohexane for 8 hours at room temperature. After filtration and rinsing of the $MnO_2$, the filtrate is freed from the acetone. The residue is dissolved in 35 ml of tetrahydrofuran. 5 mg of $OsO_4$ are added and the mixture is cooled to −20° C. After 10 ml of $H_2O_2$ (30%) have been added, the mixture is left for 16 hours at −20° C. Solid $Na_2S_2O_5$ is added, while cooling with ice, until a negative potassium iodide/starch reaction is obtained. Thereafter, 100 ml of saturated sodium chloride solution are added. The mixture is extracted with ether, the ether phase is dried over $MgSO_4$ and the ether is then removed. The residue is filtered with ether through 5 g of silica gel, the filtrate is evaporated down and the residue is subjected to steam distillation.

EXAMPLE 6

3 g of extract and 10 mg of Co(III) acetylacetonate are dissolved in 15 ml of 1,4-dioxane, and 1 ml of $H_2O_2$ (30%) is added. After 3 days at room temperature, 10 mg of $AgBF_4$ and then 3 ml of $H_2O_2$ (30%) are added. After 16 hours, $Na_2S_2O_5$ is added, while cooling with ice, until a negative potassium iodide/starch reaction is obtained. After the mixture has been partitioned between ether and saturated sodium chloride solution, the organic phase is washed with semisaturated sodium chloride solution, dried over $MgSO_4$ and evaporated down in vacuo, and the residue is then subjected to fractionation over silica gel.

What is claimed is:

1. A process for producing aromatic substances comprising:

providing a diterpene fraction in a solvent; and oxidizing said diterpene fraction in the absence of photochemically active radiation with a catalyst/oxidizing agent system wherein said catalyst/oxidizing agent system is selected from the group consisting of osmium tetroxide/sodium metaperiodate, osmium tetroxide/hydrogen peroxide/sodium metaperiodate, potassium permanganate/sodium metaperiodate, cerium(IV) sulfate/hydrogen peroxide, osmium tetroxide/hydrogen peroxide, silver fluoborate/hydrogen peroxide and silver nitrate/sodium peroxodisulfate.

2. The process of claim 1 wherein said oxidation is performed in water.

3. The process of claim 1 wherein said oxidation is performed in water soluble inert organic solvents.

4. The process of claim 2 wherein said catalysts are soluble in said water.

5. The process of claim 3 wherein said catalysts are soluble in said inert organic solvents.

6. The process of claims 2 or 3 wherein said catalysts are used in the amount of 0.01–5% by weight, relative to the amount of said diterpene fraction used.

7. The process of claims 2 or 3 wherein said oxidation is performed at a temperature between −20 and 60 degrees centigrade.

8. The process of claims 2 or 3 wherein said oxidation occurs during a period of 60 minutes to 3 weeks.

9. The process of claims 2 or 3 wherein said aromatic substances are separated from the reaction mixture by steam distillation.

10. The process of claims 2 or 3 wherein the said diterpene fraction is treated with dilute or buffered protic acids before the oxidation.

11. The process of claims 2 or 3 wherein the said diterpene fraction is preoxidized with a mild oxidizing agent.

12. The process of claim 11 wherein said mild oxidizing agent is manganese dioxide.

13. The process of claims 2 or 3 wherein said diterpene fraction is derived synthetically.

14. The process of claims 2 or 3 wherein said diterpene fraction is extracted from the surface resin of tobacco plants, parts of tobacco plants, raw tobacco, tobacco waste, or plant gum derived from tobacco blossoms.

* * * * *